US008684766B2

(12) United States Patent
Kakino et al.

(10) Patent No.: US 8,684,766 B2
(45) Date of Patent: Apr. 1, 2014

(54) CONNECTOR

(75) Inventors: Masayoshi Kakino, Kanagawa (JP); Kazumi Nakazuru, Kanagawa (JP)

(73) Assignee: KYOCERA Connector Products Corporation, Kanagawa (JP)

( * ) Notice: Subject to any disclaimer, the term of this patent is extended or adjusted under 35 U.S.C. 154(b) by 98 days.

(21) Appl. No.: 13/224,909

(22) Filed: Sep. 2, 2011

(65) Prior Publication Data

US 2012/0058662 A1 Mar. 8, 2012

(30) Foreign Application Priority Data

Sep. 3, 2010 (JP) ..... 2010-197647
Nov. 5, 2010 (JP) ..... 2010-248736

(51) Int. Cl.
*H01R 12/24* (2006.01)

(52) U.S. Cl.
USPC ..... 439/495; 439/260

(58) Field of Classification Search
USPC ..... 439/495, 499, 67, 260
See application file for complete search history.

(56) References Cited

U.S. PATENT DOCUMENTS

| | | | | |
|---|---|---|---|---|
| 7,677,917 | B2 * | 3/2010 | Hemmi et al. | 439/495 |
| 2006/0089045 | A1 * | 4/2006 | Miura et al. | 439/495 |
| 2007/0202737 | A1 * | 8/2007 | Wei et al. | 439/495 |
| 2009/0298319 | A1 * | 12/2009 | Takahashi et al. | 439/329 |

FOREIGN PATENT DOCUMENTS

| | | |
|---|---|---|
| JP | 09-161895 | 6/1997 |
| JP | 2009-070758 | 4/2009 |
| JP | 2009-266457 | 11/2009 |
| JP | 4413961 | 11/2009 |

* cited by examiner

*Primary Examiner* — Hien Vu
(74) *Attorney, Agent, or Firm* — McCormick, Paulding & Huber LLP

(57) ABSTRACT

A connector includes an insulator including contact insertion grooves and partition walls positioned therebetween, the contact insertion grooves being elongated in an insertion/removal direction of a thin plate-shaped object inserted into the insulator and arranged in a direction orthogonal thereto; and contacts inserted into the contact insertion grooves, each contact including first and second contact portions, and a connecting portion which connects the first and second contact portions to each other, wherein at least one of the first and second contact portions comes in contact with the thin plate-shaped object when the thin plate-shaped object is inserted into the insulator. A hollow portion is formed in each partition wall of the insulator so as to overlap part of each contact as viewed in a contact arranging direction, and so as to be prevented from being communicatively connected with the contact insertion grooves by the partition walls.

7 Claims, 10 Drawing Sheets

CONNECTOR

CROSS REFERENCE TO RELATED APPLICATION

The present invention is related to and claims priority of the following co-pending applications, namely, Japanese Patent Application No. 2010-197647 filed on Sep. 3, 2010, and Japanese Patent Application No. 2010-248736 filed on Nov. 5, 2010.

BACKGROUND OF THE INVENTION

1. Field of the Invention

The present invention relates to a connector to which a thin plate-shaped connecting object such as an FPC or FFC, etc., is to be connected.

2. Description of the Prior Art

A connector via which a circuit board (rigid board) and a thin plate-shaped connecting object (e.g., an FPC or FFC, etc.) are electrically connected is usually provided with an insulator and a plurality of contacts. The insulator is provided with a groove into which the connecting object is insertable, and from which the connecting object is removable, and a plurality of contact insertion grooves which are elongated in the connecting object insertion/removal direction and arranged in a direction orthogonal to the connecting object insertion/removal direction, and the plurality of contacts are inserted into the plurality of contact insertion grooves of the insulator, respectively. The plurality of contacts are connected to conductor traces of a circuit pattern formed on a surface of the circuit board. Upon the connecting object being inserted into the aforementioned groove of the insulator, the connecting object comes into contact with each of the aforementioned plurality of contacts, so that the circuit board and the connecting object are electrically connected to each other via the plurality of contacts.

This connector is disclosed in Japanese Patent Publication No. 4,413,961.

To improve the high frequency property of an electrical signal fed to this type of connector (the contacts thereof), it is required to make the impedance (value) of the connector close to the impedance (value) of the circuit board and the connecting object as much as possible.

However, the insulator is provided with partition walls which are formed between the plurality of contact insertion grooves so that each partition wall separates the adjacent contact insertion grooves from each other, and the relative permittivity of the synthetic resin which forms the insulator is usually high (e.g., the order of three to four). Accordingly, such a conventional type of connector has a structure in which the coupling capacitance between adjacent contacts easily increases, and the impedance (value) of the connector tends to decrease largely as compared with the impedance (value) of the circuit board and the connecting object.

SUMMARY OF THE INVENTION

The present invention provides a connector in which a plurality of contacts are arranged on an insulator and supported thereby and which is configured to be capable of improving the high frequency property of the connector.

According to an aspect of the present invention, a connector is provided, including an insulator, into which a thin plate-shaped object to be connected to the connector is removably insertable, including a plurality of contact insertion grooves and a plurality of partition walls that are positioned between the contact insertion grooves to separate the contact insertion grooves from one another, the contact insertion grooves being elongated in an insertion/removal direction of the thin plate-shaped object and arranged in a direction orthogonal to the insertion/removal direction; and a plurality of contacts which are inserted into the contact insertion grooves, respectively, each of the contacts including a first contact portion and a second contact portion that are spaced from each other in a direction of thickness of the thin plate-shaped object, and a connecting portion which connects the first contact portion and the second contact portion to each other, wherein at least one of the first contact portion and the second contact portion comes in contact with the thin plate-shaped object when the thin plate-shaped object is inserted into the insulator. A hollow portion is formed in each of the plurality of partition walls of the insulator in such a manner as to overlap part of each contact of the plurality of contacts as viewed in a contact arranging direction in which the contacts are arranged, and in such a manner as to be prevented from being communicatively connected with the contact insertion grooves in the contact arranging direction by the plurality of partition walls.

It is desirable for the hollow portion to be formed in the insulator so as to overlap the connecting portions of the plurality of contacts as viewed in the contact arranging direction.

It is desirable for the hollow portion to be formed in the insulator so as to overlap at least one of the first contact portion and the second contact portion as viewed in the contact arranging direction.

It is desirable for the first contact portion to be fixed to a bottom wall of the insulator, and for a recess to be formed on a surface of the first contact portion which faces the bottom wall of the insulator.

It is desirable for the hollow portion to be formed in the insulator so as to overlap the recess as viewed in the contact arranging direction.

It is desirable for the connecting portion to connect a middle portion of the first contact portion in a lengthwise direction thereof and a middle portion of the second contact portion in a lengthwise direction thereof to each other. The first contact portion includes a tail portion which is formed at one end thereof in the lengthwise direction of the first contact portion and electrically connected to a circuit board. The second contact portion includes a contacting portion which is formed at one end thereof in the lengthwise direction of the second contact portion and which comes in contact with the thin plate-shaped object when the thin plate-shaped object is inserted in between the first contact portion and the second contact portion.

It is desirable for the second contact portion to include a pressure-receiving portion which is formed on an opposite side of the connecting portion from the contacting portion in the elongated direction of the second contact portion, wherein the connector further includes an actuator which is rotatably mounted to the insulator and which includes a pressing portion positioned between the pressure-receiving portion and a portion of the first contact portion which faces the pressure-receiving portion. The pressing portion does not press the pressure-receiving portion of the second contact portion when the actuator is positioned substantially orthogonal to the insertion/removal direction. The pressing portion presses the pressure-receiving portion to bias the contacting portion of the second contact portion toward the first contact portion when the actuator is tilted in a direction away from the contacting portion until the actuator becomes substantially parallel to the insertion/removal direction.

It is desirable for the first contact portion includes a tail portion which is formed at one end thereof in the lengthwise direction of the first contact portion and electrically connected to a circuit board, for the second contact portion to include a contacting portion formed at one end thereof which is farther from the tail portion of the first contact portion than the other end of the second contact portion in the lengthwise direction of the second contact portion, the contacting portion coming in contact with the thin plate-shaped object when the thin plate-shaped object is inserted in between the first contact portion and the second contact portion, and wherein the connecting portion connects the other end of the second contact portion and the first contact portion to each other.

It is desirable for the connector to include an actuator which is rotatably mounted to the insulator and which includes a pressing portion positioned between the second contact portion and a portion of the first contact portion which faces the second contact portion. The pressing portion does not press the thin plate-shaped object which is inserted into the insulator when the actuator is positioned substantially orthogonal to the insertion/removal direction. The pressing portion presses the thin plate-shaped object toward the first contact portion when the actuator is tilted until becoming substantially parallel to the insertion/removal direction.

It is desirable for the first contact portion to be fixed to a bottom wall of the insulator, wherein a recess is formed on a surface of the first contact portion which faces the bottom wall of the insulator, the recess is positioned between the portion of the first contact portion that faces the pressure-receiving portion and the bottom wall of the insulator, and wherein both ends of the recess in the insertion/removal direction are in contact with the bottom wall of the insulator.

In the present invention, a hollow portion is formed in each partition wall in such a manner as to overlap part of each contact as viewed in a contact arranging direction in which the plurality of contacts are arranged and as to be prevented from being communicatively-connected to the plurality of contact insertion grooves in the contact arranging direction by the plurality of partition walls. The relative permittivity of this hollow portion (air space) is 1, thus being lower than the relative permittivity of a typical insulator (partition wall). Accordingly, in the connector according to the present invention, the coupling capacitance between adjacent contacts does not easily increase, so that the impedance (value) of the connector can be brought closer to the impedance (value) of the circuit board and the connecting object as compared with a conventional connector having no hollow portion corresponding to the hollow portion provided in the present invention. Therefore, the high frequency property of an electrical signal fed to the connector (the contacts thereof) can be improved.

BRIEF DESCRIPTION OF THE DRAWINGS

The present invention will be discussed below in detail with reference to the accompanying drawings, in which.

DESCRIPTION OF THE EMBODIMENTS

Figure 1:
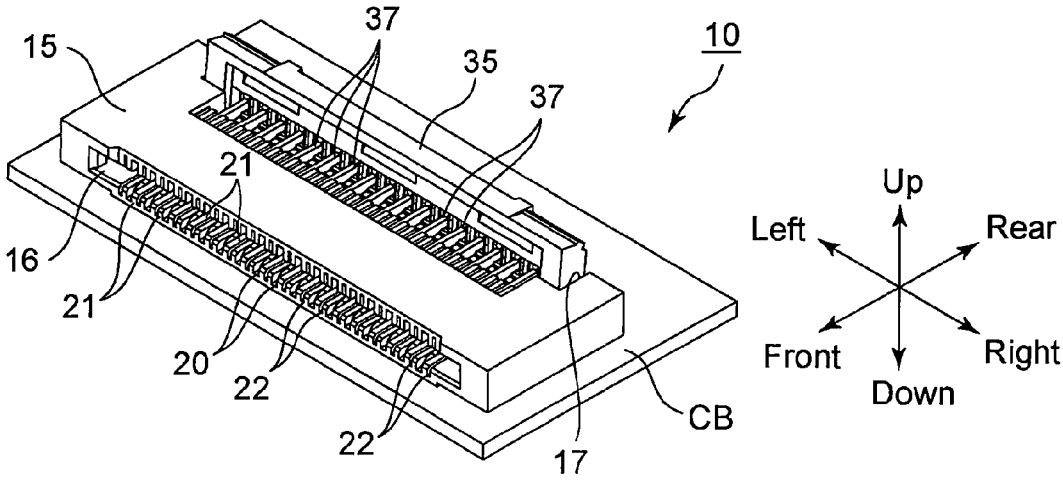
FIG. 1 is a front perspective view of an embodiment of a connector according to the present invention, showing a state where the rotational actuator of the connector is in the unlocked position.
Figure 2:
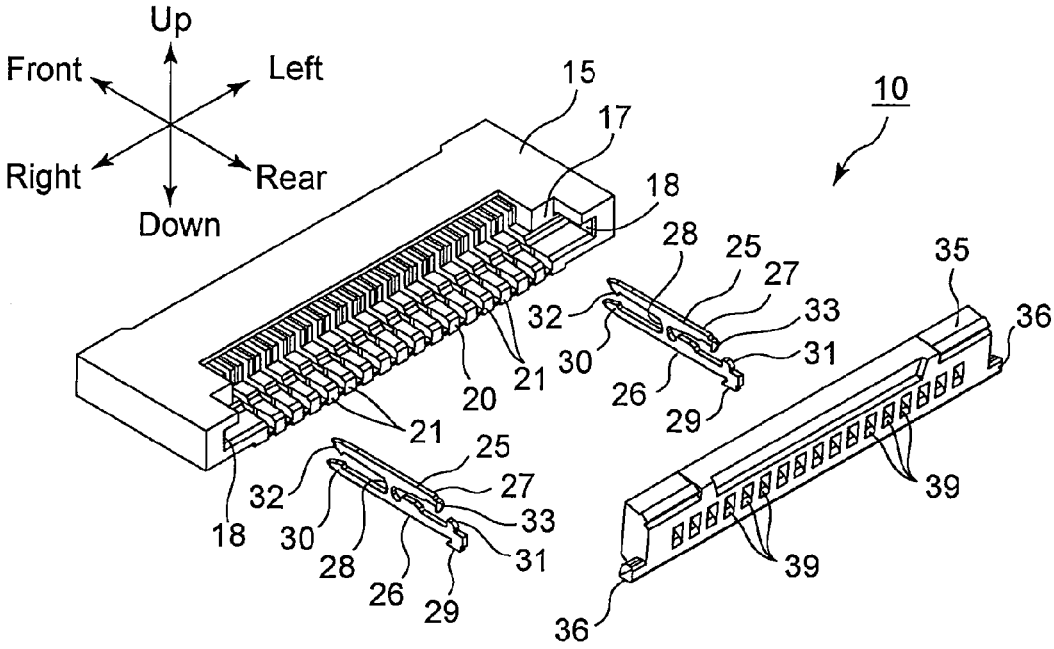
FIG. 2 is an exploded rear perspective view of the connector.
Figure 3:
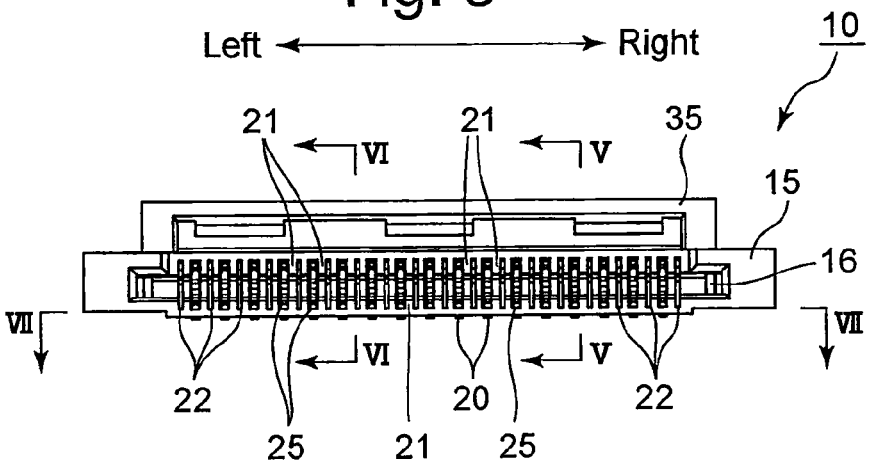
FIG. 3 is a front elevational view of the connector with the rotational actuator in the unlocked position.
Figure 4:
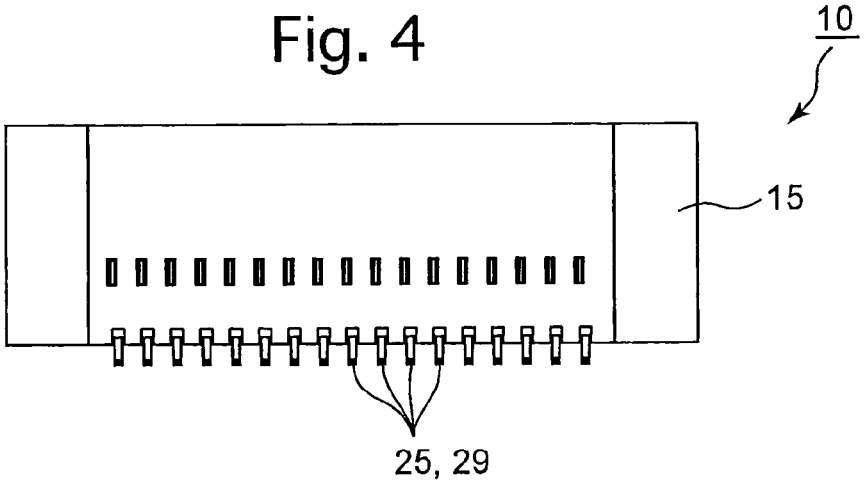
FIG. 4 is a bottom view of the connector with the rotational actuator in the unlocked position.

An embodiment of a connector according to the present invention will be hereinafter discussed with reference to FIGS. 1 through 11. In the following descriptions, forward and rearward directions, leftward and rightward directions, and upward and downward directions of the connector 10 are determined with reference to the directions of the double-headed arrows shown in the drawings.

The connector 10 is a so-called back flip lock connector and is provided with an insulator 15, a total of seventeen contacts 25 and a rotational actuator 35, which constitute major components of the connector 10.

The insulator 15 is formed from electrical-insulative and heat-resistant synthetic resin by injection molding. The insulator 15 is provided, on the front thereof except the left and right ends, with an FFC insertion groove 16 which is recessed rearward to a middle part of the insulator 15. The insulator 15 is provided, on the rear side thereof except the left and right ends, with an actuator receiving recess 17. The insulator 15 is provided, on the rear surfaces thereof in the vicinity of the left and right sides of the insulator 15, with a pair of bearing recesses 18, respectively, which are communicatively connected to the rotational actuator receiving recess 17. The insulator 15 is provided at the front thereof with a total of seventeen contact insertion grooves 20 which are linearly formed to elongate in the rearward direction and are arranged at predetermined intervals in the leftward/rightward direction. As shown in the drawings, each contact insertion groove 20 is open at both ends in the forward/rearward direction and is substantially (lowercase) h-shaped in a side view (resembling a reversed lowercase h lying on its side). The insulator 15 is provided between the seventeen contact insertion grooves 20 with a total of sixteen partition walls 21 which separate the seventeen contact insertion grooves 20 from one another. Similar to each contact insertion groove 20, each partition wall 21 is shaped into a substantially (lowercase) h-shaped in a side view (resembling a reversed lowercase h lying on its side). The insulator 15 is provided in different portions thereof (specifically, portions of the sixteen partition walls 21, a portion of the insulator 15 on the left-hand side of the leftmost contact insertion groove 20 and a portion of the insulator 15 on the right-hand side of the rightmost contact insertion groove 20), with a total of eighteen hollow portions 22, respectively, which are arranged in the leftward/rightward direction. Each hollow portion 22 is substantially U-shaped in a side view (see FIG. 6). As shown in the drawings, both sides (left and right sides) of each hollow portion 22 of the hollow portions 22 that are respectively formed in the partition walls 21 are closed by the partition walls 21, respectively. In addition, the right side of the leftmost hollow portion 22 is closed by part of the insulator 15, while the left side of the rightmost hollow portion 22 is closed by another part of the insulator 15.

The total of seventeen contacts 25 are each formed from a thin base material made of a resilient copper alloy (e.g., phosphor bronze, beryllium copper or titanium copper) or a resilient Corson-copper alloy and molded into the shape shown in the drawings (by stamping), and is coated with firstly nickel (Ni) plating as base plating and subsequently gold (Au) plating as finish plating.

As shown in the drawings, each contact 25 is substantially H-shaped in a side view and is provided with a fixed contact portion (first contact portion) 26, a movable contact portion (second contact portion) 27 and a deformable connecting portion (connecting portion) 28. The fixed contact portion 26 is elongated substantially in the forward/rearward direction. The movable contact portion 27 is elongated substantially in the forward/rearward direction and is shorter than the fixed contact portion 26. The deformable connecting portion 28 is resiliently deformable and connects middle portions of the fixed contact portion 26 and the movable contact portion 27 to each other. The fixed contact portion 26 is provided at the rear bottom end thereof with a hook-shaped engaging portion (tail portion) 29 which projects downward and forwards. The fixed contact portion 26 is provided on the top thereof at the front end rear end of the fixed contact portion 26 with a contacting projection (contacting projection; lower contacting projection) 30. The fixed contact portion 26 is also provided on the top thereof at the rear end of the fixed contact portion 26 with a retaining projection 31. Each of the contacting projection 30 and the retaining projection 31 projects upward. The movable contact portion 27 is provided at the front end thereof with a contacting projection (upper contacting projection) 32 which projects downward, and is further provided, on a lower surface of the movable contact portion 27 in the vicinity of the rear end thereof, with a locking recess (pressure-receiving portion) 33 which is recessed upward.

Figure 5:
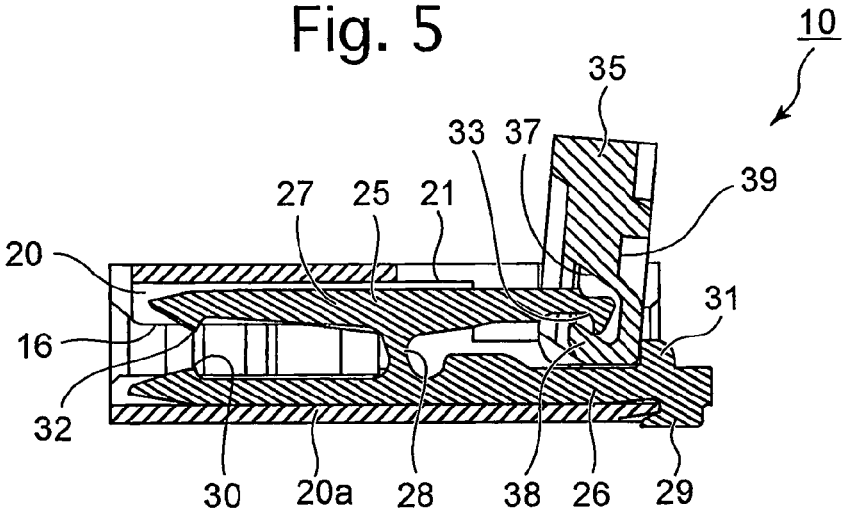
FIG. 5 is a cross sectional view taken along the line V-V shown in FIG. 3, viewed in the direction of the appended arrows.
Figure 6:
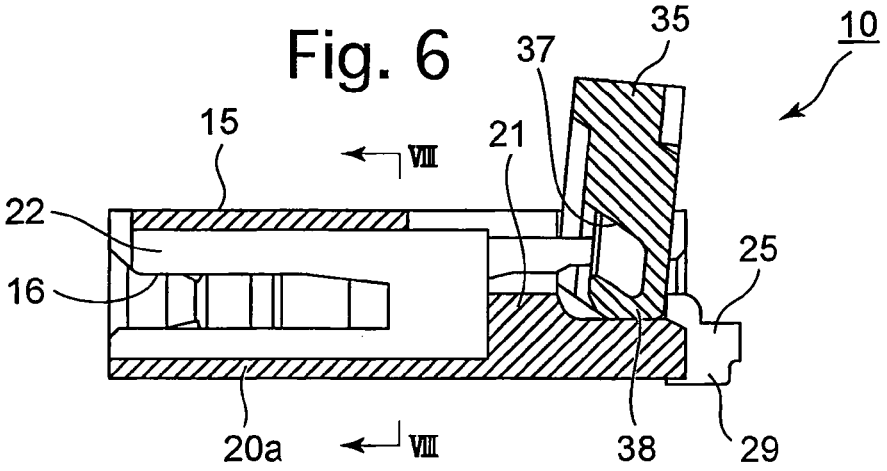
FIG. 6 is a cross sectional view taken along the line VI-VI shown in FIG. 3, viewed in the direction of the appended arrows.
Figure 7:
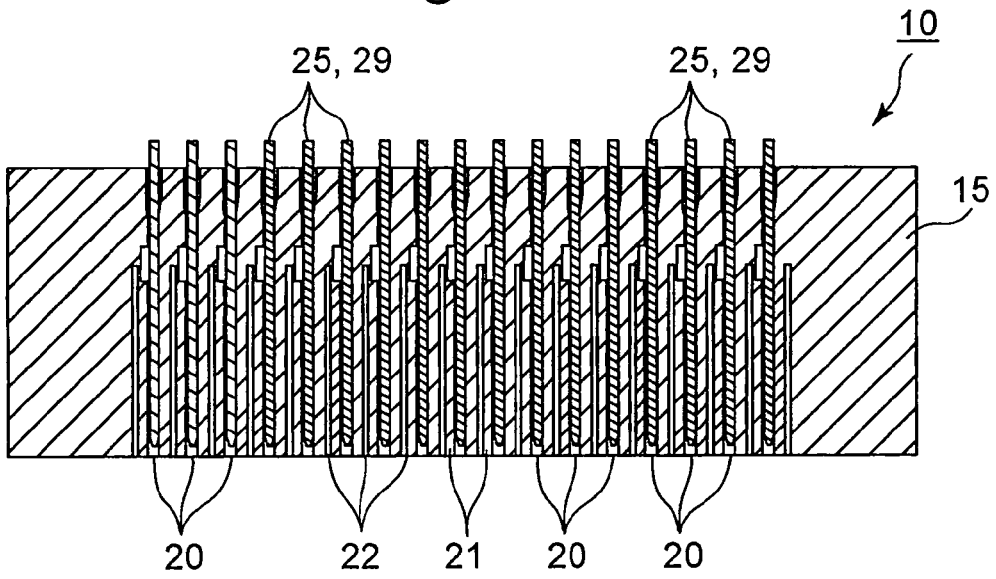
FIG. 7 is a cross sectional view taken along the line VII-VII shown in FIG. 3, viewed in the direction of the appended arrows.
Figure 8:
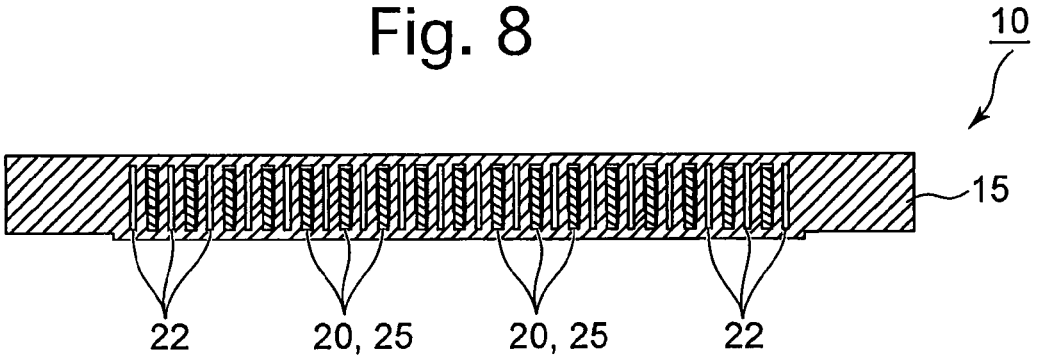
FIG. 8 is a cross sectional view taken along the line VIII-VIII shown in FIG. 6, viewed in the direction of the appended arrows.
Figure 10:
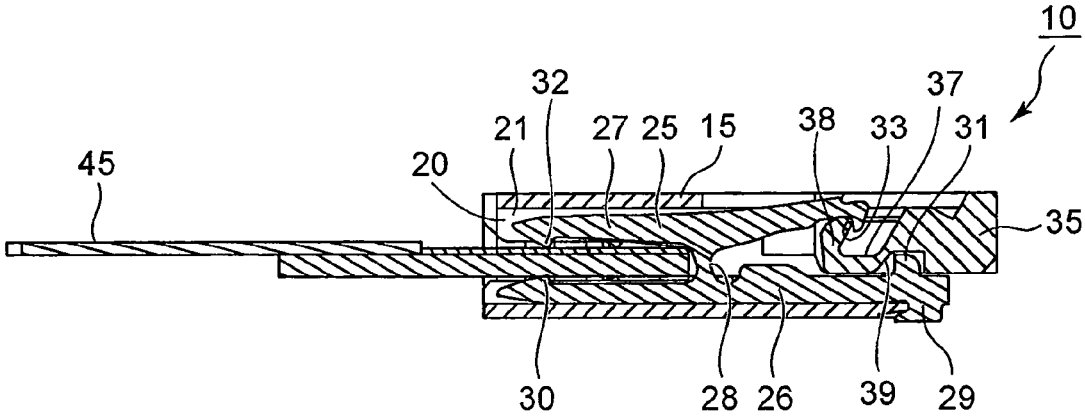
FIG. 10 is a cross sectional view similar to that of FIG. 5, showing the connector and the FFC in the same state as that shown in FIG. 9.

The seventeen contacts 25 are inserted into the seventeen contact insertion grooves 20, respectively, from the rear of the insulator 15. As shown in FIGS. 5 and 10, upon each contact 25 being inserted into the associated contact insertion groove 20, a lower surface of the fixed contact portion 26 of each contact 25 comes in contact with the bottom surface of the associated contact insertion groove 20, the upper surface of the movable contact portion 27 of each contact 25 is spaced downward from the ceiling of the associated contact insertion groove 20, and the hook-shaped engaging portion 29 of the fixed contact portion 26 of each contact 25 is engaged with the rear edge of the bottom of the associated contact insertion groove 20. In addition, an engaging projection (not shown) formed on a side of the fixed contact portion 26 of each contact 25 digs into (cuts into) a side surface in the associated contact insertion groove 20 (not shown), and accordingly, the fixed contact portion 26 of each contact 25 is fixed to the bottom of the associated contact insertion groove 20 (a bottom wall 20*a* of the insulator 15).

The rotational actuator 35 is a tabular shaped member elongated in the leftward/rightward direction and molded out of a heat-resistant synthetic resin by injection molding using a metal mold. The rotational actuator 35 is provided, at lower ends of the left and right side surfaces thereof, with a pair of (left and right) pivots 36, respectively, which project in opposite directions away from each other in the leftward/rightward direction to be coaxial with each other. The rotational actuator 35 is provided, on a surface thereof (front surface with respect to FIGS. 1 and 5 or upper surface with respect to FIGS. 9 and 10) in the vicinity of the lower end of this surface, with a total of seventeen recesses 37 which are arranged in the leftward/rightward direction. The rotational actuator 35 is provided, at the lower end (pivoted end) thereof except both ends of this lower end in the leftward/rightward direction, with a cam portion (pressing portion) 38 which extends in the leftward/rightward direction. In addition, the rotational actuator 35 is provided in the rear surface thereof (rear surface with respect to FIGS. 1 and 5 or lower surface with respect to FIGS. 9 and 10) with a total of seventeen retaining recesses 39 arranged in the leftward/rightward direction.

The rotational actuator 35 that has the above described structure is mounted to the insulator 15 to be rotatable about the left and right pivots 36 with the lower end (except the left and right pivots 36) of the rotational actuator 35 being positioned in the rotational actuator receiving recess 17 and with the left and right pivots 36 being rotatably engaged into the left and right bearing recesses 18 of the insulator 15, respectively. The rotational actuator 35 is rotatable between an unlocked position (shown in FIGS. 1, 3, 5 and 6), in which the rotational actuator 35 extends substantially orthogonal (vertical) to the insulator 15, and a locked position (shown in FIGS. 9 and 10), in which the rotational actuator 35 lies substantially horizontal (i.e., the rotational actuator 35 has been tilted rearwardly down).

Figure 9:
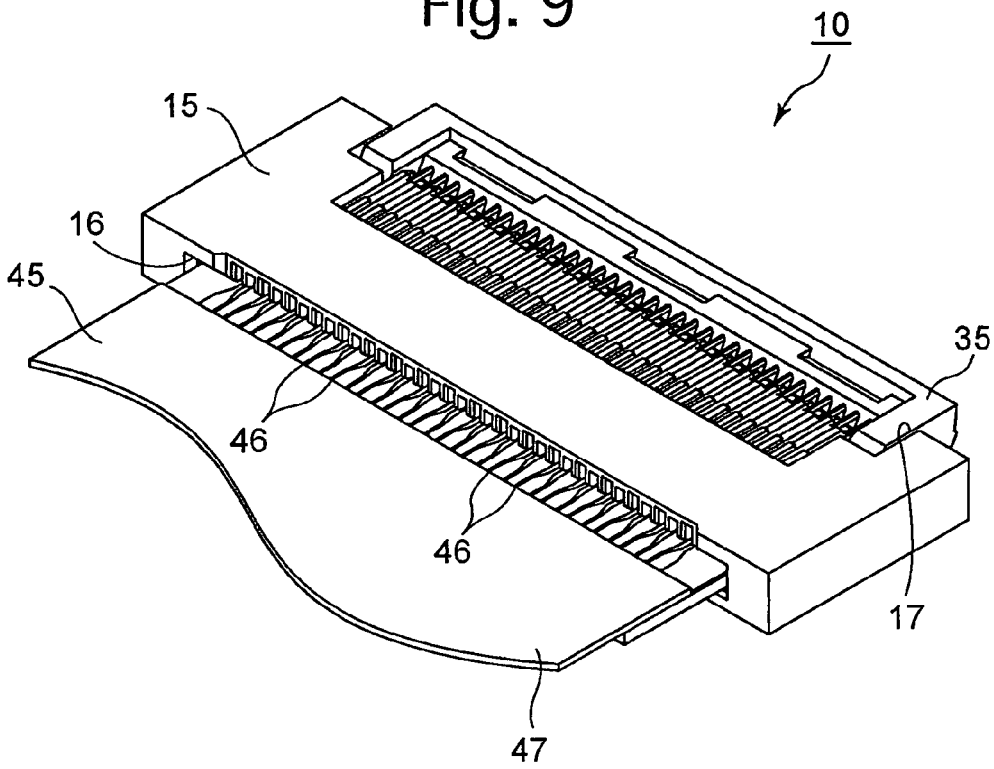
FIG. 9 is a front perspective view of the connector and an insertion end of an FFC inserted into the connector with the rotational actuator in the locked position.

When the rotational actuator 35 is in the unlocked position as shown in FIGS. 1 and 5, the rear end of the movable contact portion 27 of each contact 25 is loosely engaged in the associated recess 37 of the rotational actuator 35, so that the cam portion 38 does not press the locking recess 33 of each contact 25. On the other hand, rotating the rotational actuator 35 to the locked position as shown in FIGS. 9 and 10 causes the cam portion 38 of the rotational actuator 35 to press the locking recess 33 of each contact 25 upward, thus causing the front end of the movable contact portion 27 of each contact 25 to rotate downward about the associated deformable connecting portion 28 while resiliently deforming this deformable connecting portion 28. In addition, this rotation of the rotational actuator 35 to the locked position causes the retaining projection 31 of each contact 25 to be engaged in the associated retaining recess 39.

The connector 10 that has the above described structure is mounted onto a top surface of a circuit board CB (see FIG. 1) by soldering the hook-shaped engaging portion 29 of each contact 25 to the associated conductor trace of a circuit pattern (not shown) formed on the top surface of the circuit board CB.

When the rotational actuator 35 is in the unlocked position, an FFC (flexible flat cable) 45 that constitutes a connecting object (object to be connected to the connector 10) can be inserted into the FFC insertion groove 16 of the insulator 15 from the front side. The FFC 45 is a long and thin plate-shaped member which is flexibly deformable, and the thickness of the FFC 45 is smaller than the distance between the upper contacting projection 32 and the lower contacting projection 30 of each contact 25 when the contacts 25 are in a free state. The FFC 45 has a multi-layered structure made up of a plurality of thin films which are bonded together and is provided on an upper surface of an intermediate layer of the thin films with a total of seventeen conductor traces 46 of a circuit pattern, and the upper surface of this intermediate layer, except both end portions thereof in the lengthwise direction of the FFC 45, is covered with an insulating cover 47.

Upon one end (insertion end; the right end with respect to FIG. 10) of the FFC 45 being inserted into the FFC insertion groove 16, this insertion end of the FFC 45 is positioned in each contact 25 between a front half of the fixed contact portion 26 and a front half of the movable contact portion 27 as shown in FIG. 10. In this state, rotating the rotational actuator 35 to the locked position causes the front end of the movable contact portion 27 of each contact 25 to rotate downward, thus causing the contacting projection 32 of each contact 25 to be pressed hard against the associated conductor trace 46 of the aforementioned circuit pattern and simultaneously causes the contacting projection 30 of each contact 25 to be pressed hard against a lower surface of the insertion end of the FFC 45. Consequently, the aforementioned circuit pattern (not shown) of the circuit board CB and the circuit pattern (the conductor traces 46) of the FFC 45 are electrically connected via each contact 25.

On the other hand, if the contact pressure exerted on the FFC 45 from each contact 25 is released by returning the rotational actuator 35 to the unlocked position, the FFC can be forwardly withdrawn from the FFC insertion groove 16.

Figure 11:
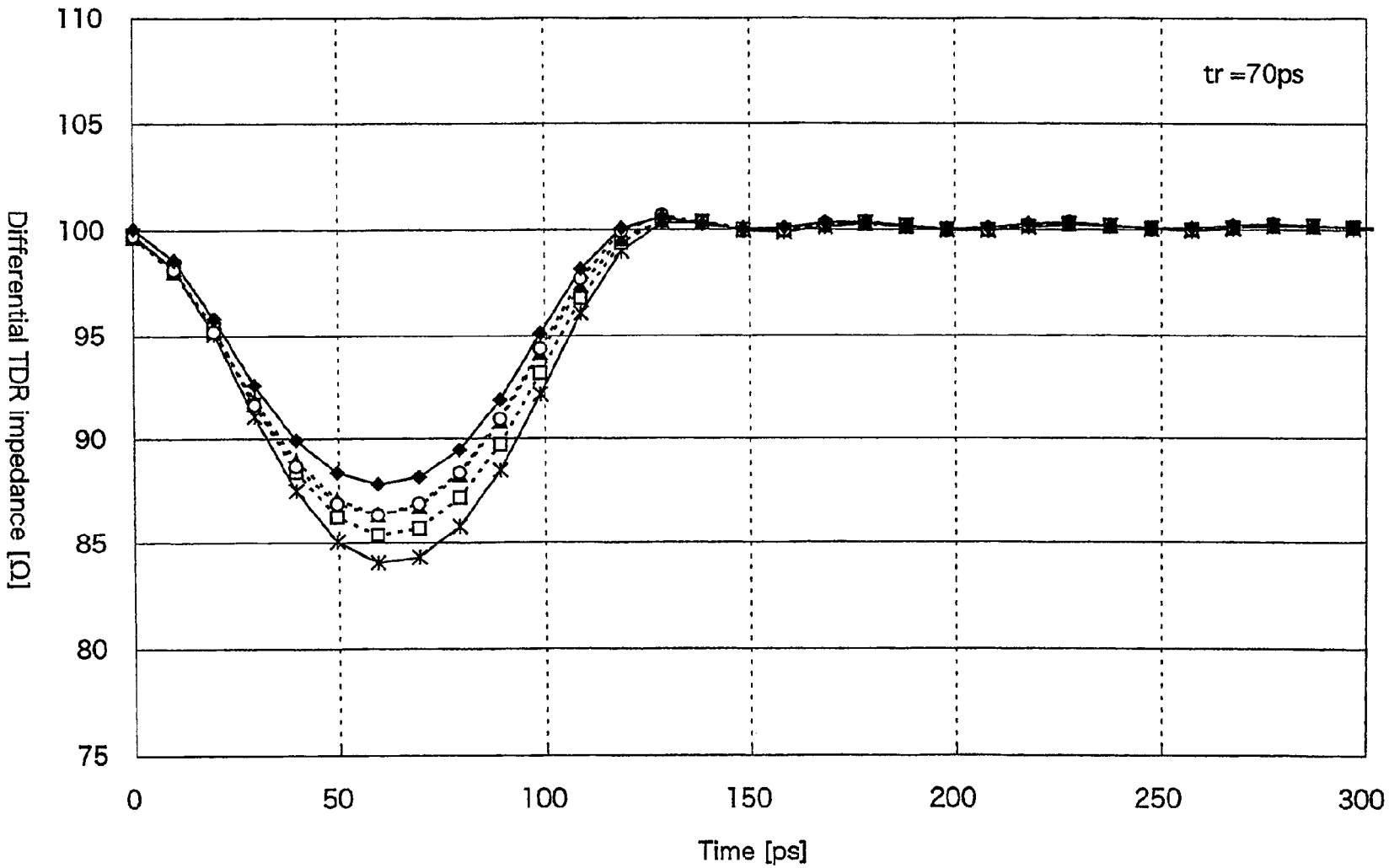
FIG. 11 is a plotted graph illustrating the relationship between time and the impedance when an electrical signal is supplied from a circuit board, to the connector and to the FFC.
Figure 12:
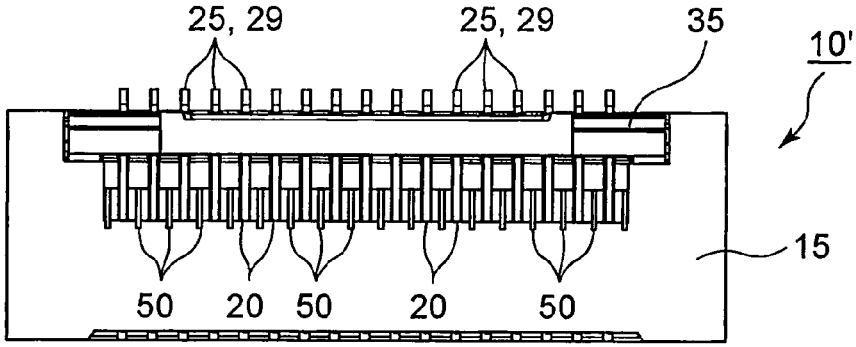
FIG. 12 is a plan view of a modified embodiment of the connector with the rotational actuator in the unlocked position.
Figure 13:
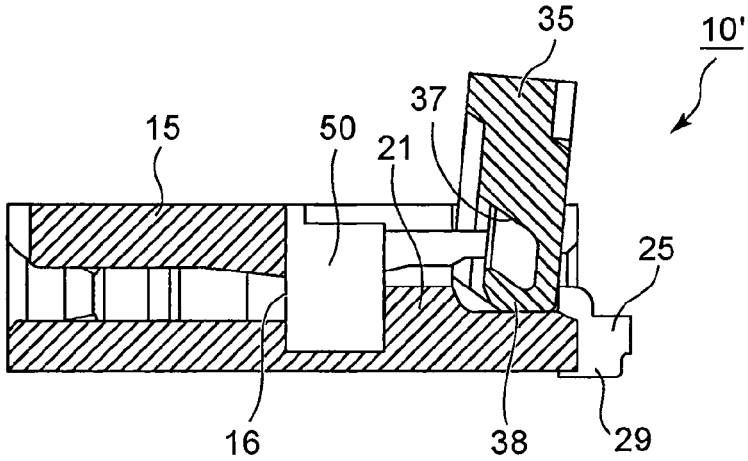
FIG. 13 is a view similar to that of FIG. 6, of the connector shown in FIG. 12.
Figure 14:
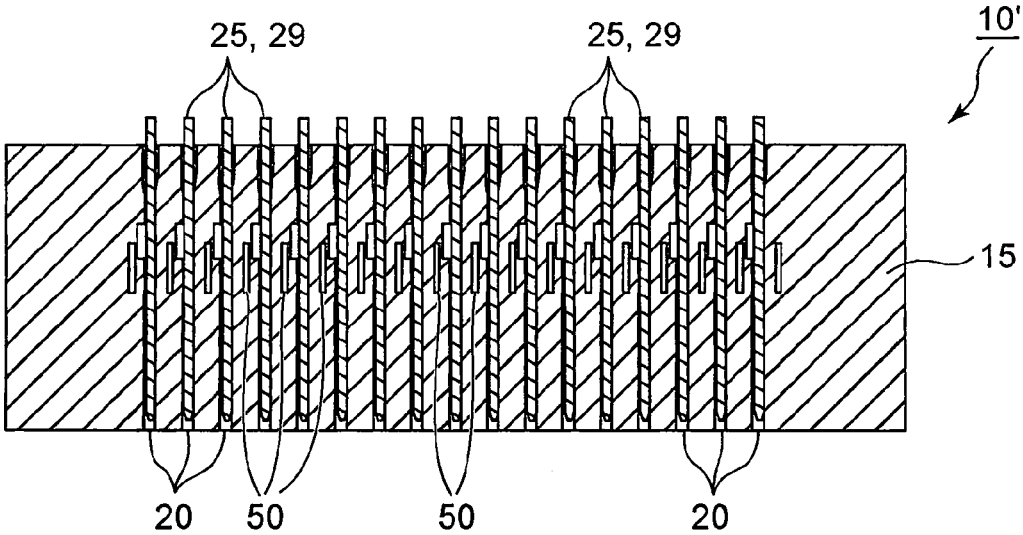
FIG. 14 is a view similar to that of FIG. 7, of the connector shown in FIG. 12.
Figure 15:
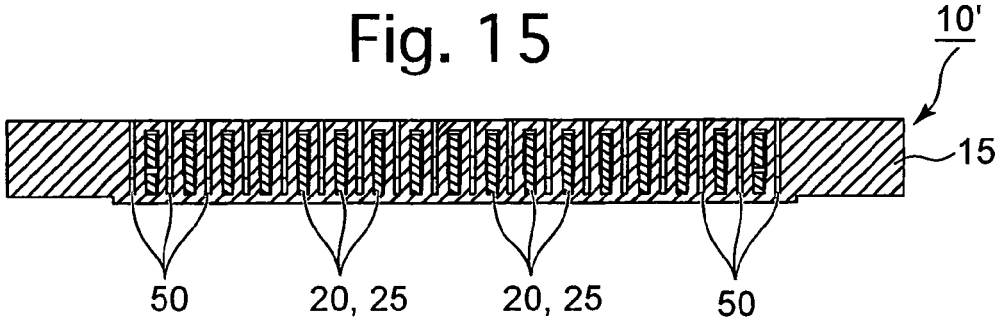
FIG. 15 is a view similar to that of FIG. 8, of the connector shown in FIG. 12.
Figure 16:
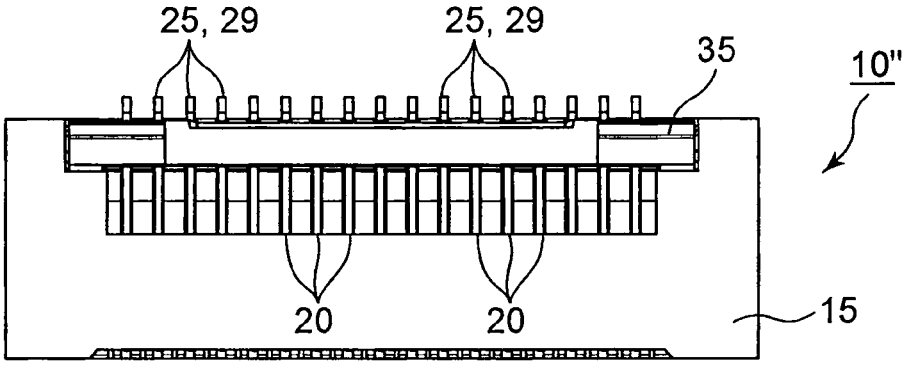
FIG. 16 is a view similar to that of FIG. 12, showing another modified embodiment of the connector.
Figure 17:
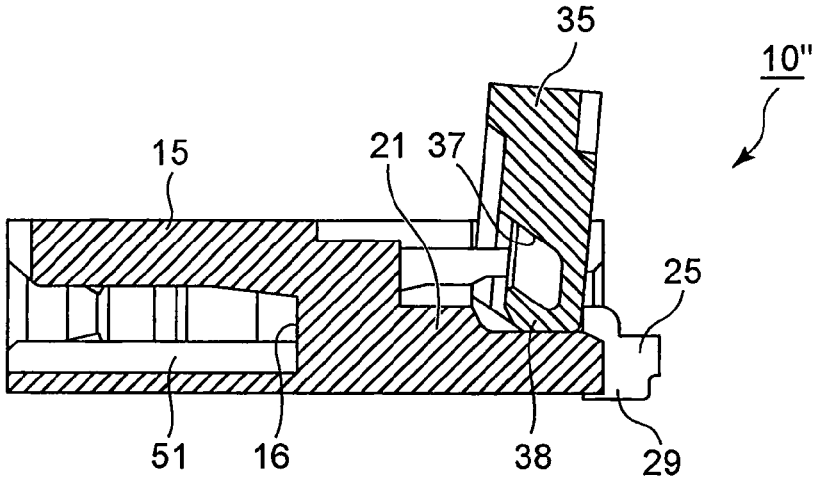
FIG. 17 is a view similar to that of FIG. 6, of the connector shown in FIG. 16.
Figure 18:
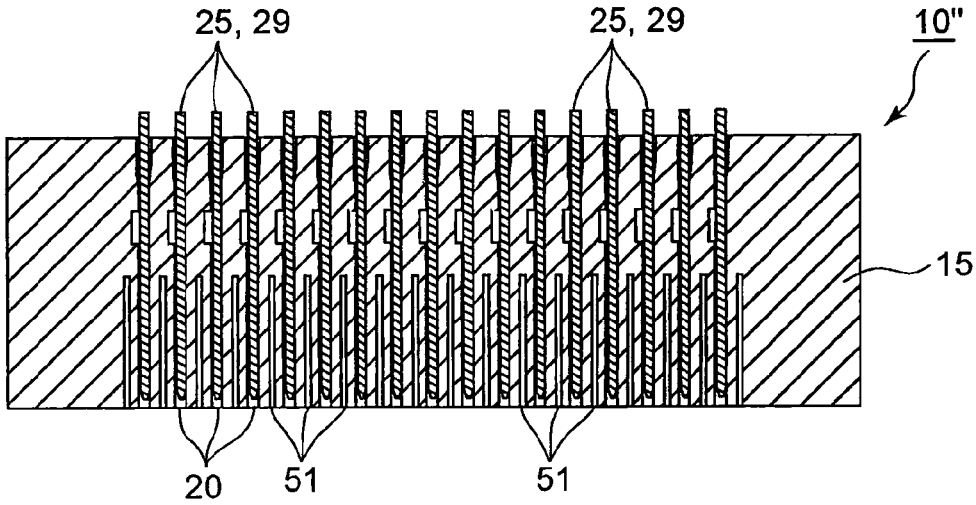
FIG. 18 is a view similar to that of FIG. 7, of the connector shown in FIG. 16.
Figure 19:
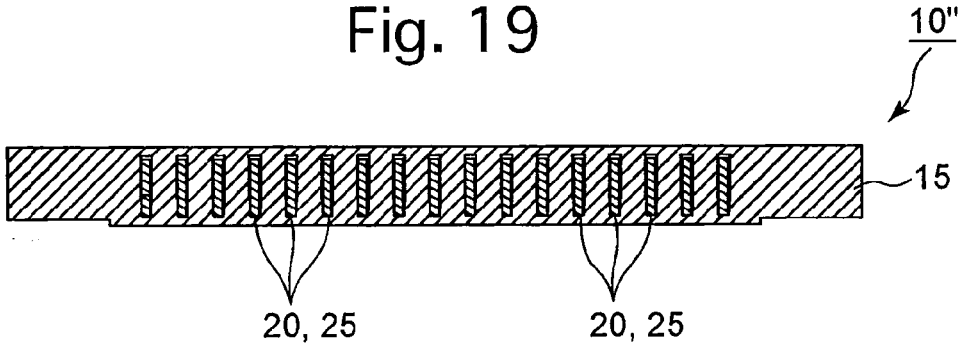
FIG. 19 is a view similar to that of FIG. 8, of the connector shown in FIG. 16.
Figure 20:
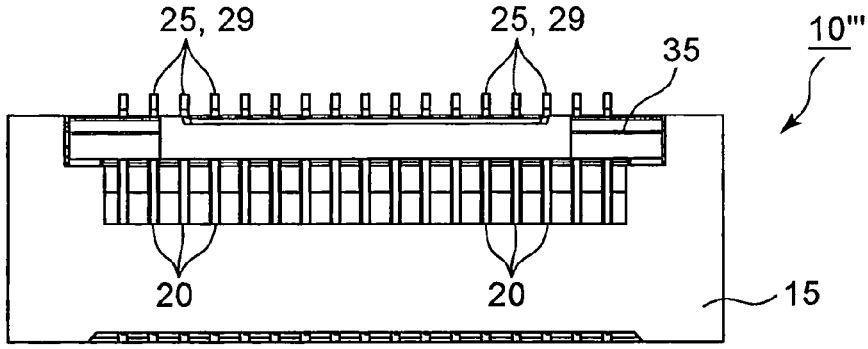
FIG. 20 is a view similar to that of FIG. 12, showing another modified embodiment of the connector.
Figure 21:
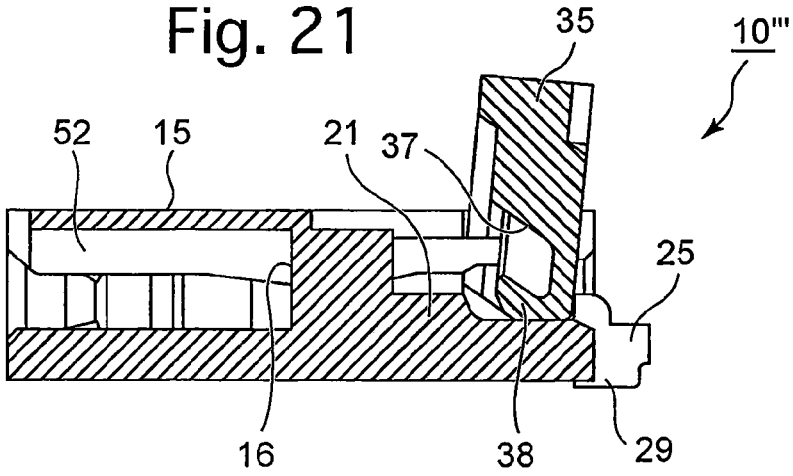
FIG. 21 is a view similar to that of FIG. 6, of the connector shown in FIG. 20.
Figure 22:
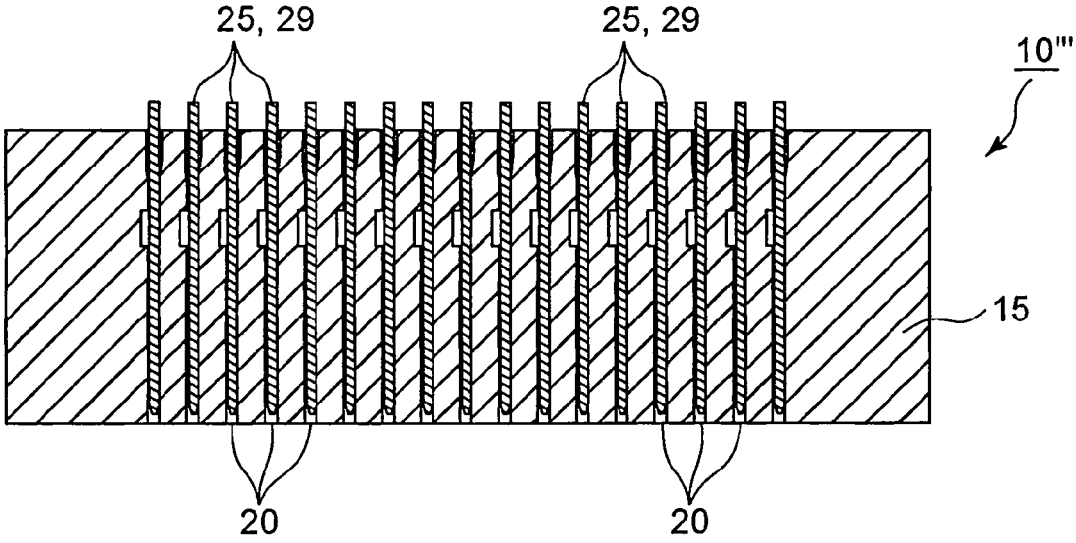
FIG. 22 is a view similar to that of FIG. 7, of the connector shown in FIG. 20.
Figure 23:
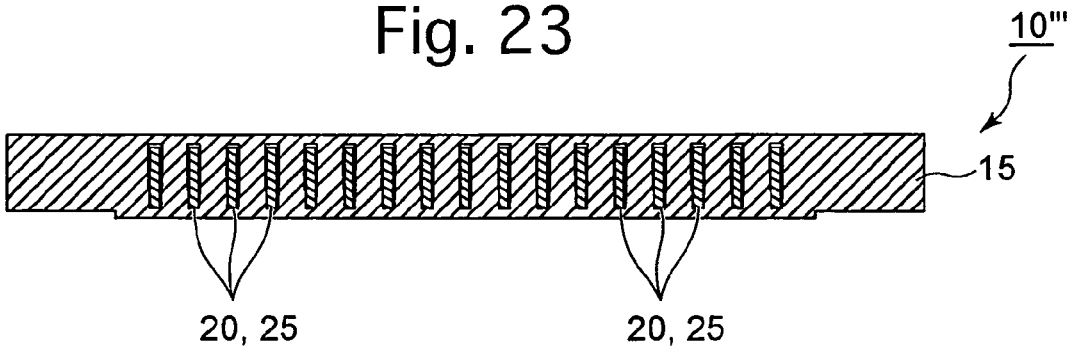
FIG. 23 is a view similar to that of FIG. 8, of the connector shown in FIG. 20.

FIG. 11 is a plotted graph illustrating the relationship between time and the impedance (value) when an electrical signal is supplied from the circuit board CB (the circuit pattern) to the FFC 45. In the horizontal axis indicating time, the time when an electrical signal enters the hook-shaped engaging portion 29 (connecting portion of each contact 25 which is connected to the circuit pattern of the circuit board CB) is defined as a reference time (zero). Since the electrical signal travels toward the FFC 45 as time passes, the horizontal axis practically shows positions of the signal paths of a signal which passes through the circuit board CB, the connector 10 (the contacts 25) and the FFC 45 (note that 0[ps] corresponds to the aforementioned connecting portion between the connector 10 (the contacts 25) and the circuit board CB; the section from 0[ps] to 130[ps] corresponds to the connector 10; and the section from 130[ps] onwards (rightward with respect to FIG. 11) corresponds to the FFC 45). An analysis was carried out using a vector network analyzer (E5071C) produced by Agilent Technologies and an impedance-controlled FFC with a contact pitch of 0.4 mm produced by BANDO DENSEN Co., ltd. on condition that the Tr (rise time) is 70 ps and the contact pitch is 0.4 mm.

In FIG. 11, a total of five line graphs are shown. Among these line graphs, the line graph that is plotted by a plurality of asterisks (*) is a graph obtained when a connector similar in structure to the connector 10, however the hollow portions 22 are omitted, is connected to the FFC 45 and the circuit board CB. As can be clearly understood from this line graph, in this case the impedances of the circuit board CB and the FFC 45 are each approximately 100 ohms; however, the minimum impedance of the connector (contacts) is approximately 84 ohms, and accordingly, there is a large difference between this minimum impedance of the connector and the impedance of the circuit board CB and the FFC 45.

On the other hand, the line graph that is plotted by a plurality of filled-in black diamonds (♦) in FIG. 11 is a graph obtained when the present embodiment of the connector 10 is connected to the FFC 45 and the circuit board CB. As can be understood from this graph, in this case also, the impedances of the circuit board CB and the FFC 45 are each approximately 100 ohms. However, the minimum impedance of the connector 10 (the contacts 25) is approximately 88 ohms, so that it can be understood that the difference between this minimum impedance of the connector 10 and the impedance of the circuit board CB and the FFC 45 has become significantly smaller. This result is due to the formation of the hollow portions 22 in the insulator 15 that are formed in such a manner as to overlay the deformable connecting portion 28 of each contact 25, overlap approximately three quarters (¾) of the fixed contact portion 26 of each contact 25 (i.e., the fixed contact portion 26 of each contact 25 from which approximately a rear quarter thereof is removed), and overlap approximately two thirds (⅔) of the movable contact portion 27 of each contact 25 (i.e., the movable contact portion 27 of each contact 25 from which approximately a rear third of the movable contact portion 27 is removed) as viewed from a lateral side (the left or right side) of the insulator 15; and also to be prevented from being communicatively connected with the contact insertion grooves 20 in the leftward/rightward direction by the partition walls 21. The relative permittivity of each hollow portion 22 (air space) is 1, thus being far lower than the relative permittivity of the synthetic resin from which the insulator 15 is made (which is approximately 3 to 4). Accordingly, the coupling capacitance between two adjacent contacts 25 between which one hollow portion 22 is formed does not easily increase, and hence the impedance (value) of the connector 10 is higher than that of a connector configured to have no hollow portions corresponding to the hollow portions 22. Therefore, when the connector 10 is connected to the circuit board CB and the FFC 45, the high frequency property of an electrical signal supplied to the connector is improved compared with the case where a connector having a conventional structure is connected to the circuit board CB and the FFC 45.

Although the present invention has been described based on the above illustrated embodiment of the connector 10, the present invention is not limited solely to this particular embodiment; making various modifications to the above illustrated embodiment of the connector 10 is possible.

For instance, if the hollow portions 22, which are formed in the partition walls 21 of the insulator 15, overlay at least part of each contact 25 (i.e., overlaps each contact 25) as viewed from a lateral side of the insulator 15, the shape (setting range) can be modified. For instance, from the hollow portions 22 in the above described embodiment of the connector 10, it is possible to omit: (1) portions of the hollow portions 22 which overlay the fixed contact portions 26, (2) portions of the hollow portions 22 which overlay the movable contact portions 27, or (3) portions of the hollow portions 22 which overlay the fixed contact portions 26 and the movable contact portions 27 (so that the hollow portions 22 include only portions thereof for overlaying the deformable connecting portions 28) as viewed from a lateral side of the insulator 15. The line graph with a plurality of hollow circles (○) in FIG. 11 is a graph obtained in the aforementioned case (1), the line graph with a plurality of black-filled triangles (▲) in FIG. 11 is a graph obtained in the aforementioned case (2), and the line graph with a plurality of black-hollow squares (□) in FIG. 11 is a graph obtained in the aforementioned case (3). As can be seen from these plotted graphs, even in the case where any of these modifications are made to the connector 10, the impedance of the connector 10 is greater than that in the case where the hollow portions 22 are not formed in the insulator 15. According to experimental study carried out by the applicant of the present invention, portions of the hollow portions 22 which overlay the deformable connecting portions 28, as viewed from a lateral side of the insulator 15, display a maximum effect (effect of preventing the coupling capacitance between any two adjacent contacts 25 from increasing), and accordingly, it is desirable that the hollow portions 22 be shaped so that each hollow portion 22 includes a portion overlaying the deformable connecting portions 28 as viewed from a lateral side of the insulator 15, regardless of the type of shape into which the hollow portions are formed.

FIGS. 12 through 23 show other modified embodiments of the connector.

The insulator 15 of a connector 10' shown in FIGS. 12 through 15 has the same basic configuration as the connector 10, and components and members of the connector 10' which are the same as those of the connector 10 (or substantially the same in function as those of the connector 10 even if slightly different in shape) are designated by the same reference numerals. Components and members of each of the other modified embodiments of the connector (connectors 10", 10''' and 10'''' that will be discussed later) which are the same as those of the connector 10 are also designated by the same reference numerals in the same manner.

The insulator 15 of the connector 10' is provided with hollow portions 50 which are different in shape from the hollow portions 22. Each hollow portion 50 is shaped to extend downward from a top surface of the insulator 15, and the position of the front end of each hollow portion 50 is the same as the position of the rear end of the FFC insertion groove 16 in the forward/rearward direction (see FIG. 13). The hollow portions 50 overlay the entire deformable connecting portions 28 and portions of the movable contact portions 27 (center portions thereof in the elongated direction of the movable contact portions 27) as viewed from a lateral side of the insulator 15.

Similar to the connector 10" the insulator 15 of a connector 10" shown in FIGS. 16 through 19 is provided with hollow portions 51 which are different in shape from the hollow portions 22. Each hollow portion 51 is shaped to extend linearly rearwards from a front end surface of the insulator 15, and the position of the rear end of each hollow portion 51 is the same as the position of the rear end of the FFC insertion groove 16 in the forward/rearward direction (see FIG. 17). The hollow portions 51 overlap the front halves of the fixed contact portions 26 as viewed from a lateral side of the insulator 15.

Similarly, the insulator 15 of a connector 10''' shown in FIGS. 20 through 23 is provided with hollow portions 52 which are different in shape from the hollow portions 22. Each hollow portion 52 is shaped to extend linearly rearwards from the front end surface of the insulator 15, and the position of the rear end of each hollow portion is the same as the position of the rear end of the FFC insertion groove 16 in the forward/rearward direction (see FIG. 21). The hollow portions 52 overlap front halves of the movable contact portions 27 as viewed from a lateral side of the insulator 15.

Figure 24:
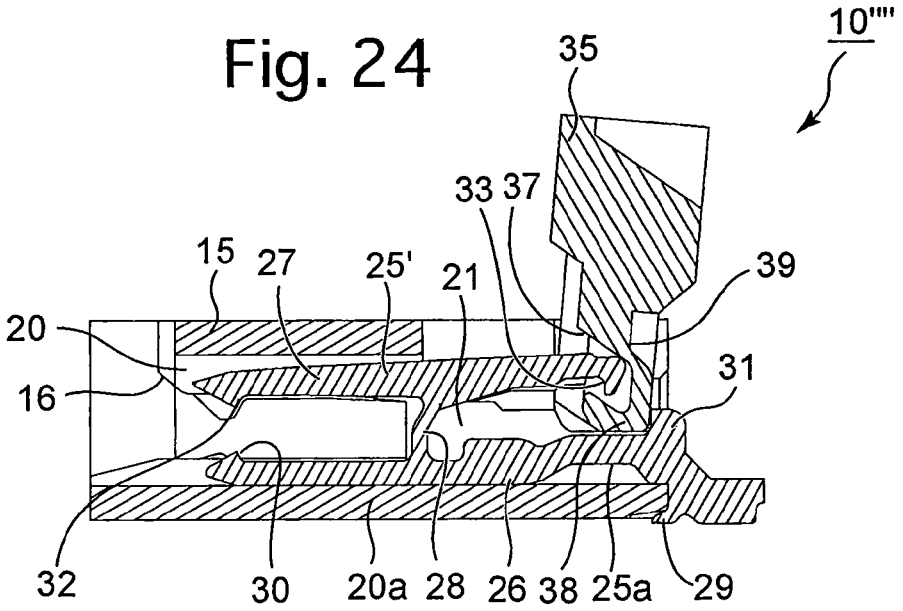
FIG. 24 is a view similar to that of FIG. 5, showing yet another modified of the connector.
Figure 25:
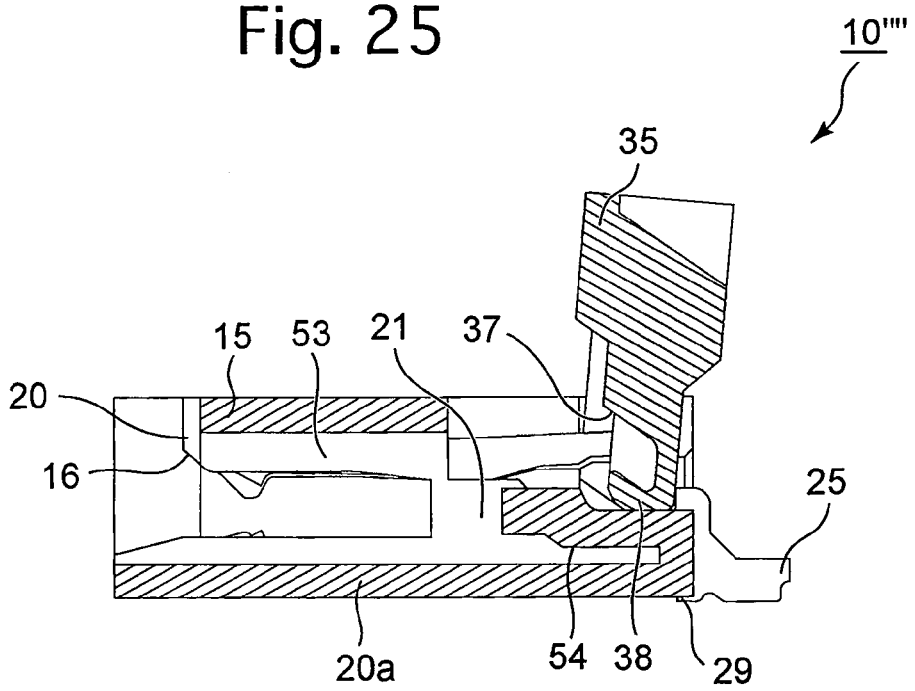
FIG. 25 is a view similar to that of FIG. 6, of the connector shown in FIG. 24.

In a modified embodiment of a connector 10'''' shown in FIGS. 24 and 25, each contact 25' (which corresponds to each contact 25 shown in FIGS. 1 through 10) is provided, on a lower surface of the fixed contact portion 26 thereof in the vicinity of the rear end of the contact 25', with a recess **25*a*. The recess 25*a* has a trapezoidal shape in a side view and is recessed over the entire width of the fixed contact portion 26 in the leftward/rearward direction. The entire lower surface of the fixed contact portion 26 of each contact 25' except the portion thereof on which the recess 25*a* is formed is in contact with the bottom of the associated contact insertion groove 20 (the bottom wall 20*a* of the insulator 15), and accordingly, both a portion of the lower surface of the fixed contact portion 26 immediately in front of the recess 25*a* and another portion of the lower surface of the fixed contact portion 26 immediately behind the recess 25*a* (this portion is positioned immediately above the front end of the associated hook-shaped engaging portion 29) are in contact with the bottom wall 20*a* of the insulator 15. The formation of the recess 25*a* on the fixed contact portion 26 of each contact 25' in such a manner reduces the surface area of the laterally-opposed surfaces of the fixed contact portions 26 adjacent to each other (the surface area of the laterally-opposed portions of the fixed contact portions 26 adjacent to each other if the partition walls 21 were omitted); and moreover, a hollow portion (spacing) is formed between the recess 25*a* of each contact 25' and the bottom of the associated contact insertion groove 20, which makes it possible to improve the high frequency property of each contact 25'**.

In addition, the insulator 15 of the connector 10'''' is provided with hollow portions 53 which are different in shape from the hollow portions 22. Each hollow portion 53 is substantially (lowercase) h-shaped in a side view (resembling a reversed lowercase h lying on its side). The rear end 54 of each hollow portion 53 extends to a position immediately below the cam portion 38 of the rotational actuator 35, and at least a part of the rear end 54 overlaps the recess **25*a* of the fixed contact portion 26 as viewed from a lateral side of the insulator 15, which consequently increases the area of a portion of each hollow portion 53 which overlaps the associated contact insertion groove 20 (the associated contact 25'), thus making the coupling capacitance between any two adjacent contacts 25' far more difficult to increase, so that the impedance (value) of the connector 10'''' becomes higher than that in the case where neither the recess 25*a* nor the rear end portion 54** is formed.

Moreover, although the cam portion 38 of the rotational actuator 35 exerts a downward force on a portion of the upper surface of the fixed contact portion 26 of each contact 25' immediately above the recess **25*a* of the associated contact 25' (i.e., on a portion of the upper surface of the fixed contact portion 26 of each contact 25' in the vicinity of the rear end thereof) when the rotational actuator 35 is rotated, such a downward force that is exerted on the portion of the upper surface of the fixed contact portion 26 of each contact 25' in the vicinity of the rear end thereof from the cam portion 38 of the rotational actuator 35 is securely received by the bottom surface 20***a* of the insulator 15 because both the front and rear lower surfaces of the fixed contact portion 26 of each contact 25' that are positioned on the opposite sides of the recess 25*a* in the forward/rearward direction are in contact with the bottom of the associated contact insertion groove 20. Therefore, the portion of the fixed contact portion 26 of each contact 25' in the vicinity of the rear end thereof does not flex by a large amount, and accordingly, the transmission characteristics can be improved without impairing either the rotational operability of the rotational actuator 35 or the stability of the position of each contact 25' (i.e., the security of the fixing force of the fixed contact portion 26 of each contact 25' relative to the bottom wall 20*a* of the insulator 15), which are fundamental requirements (capabilities) for cable connectors.

In addition, the thin plate-shaped connecting object can be a cable other than an FFC such as the FFC 45, e.g., an FPC (flexible printed circuit).

It is possible for some (more than one) of the contacts 25 or 25' to be used as ground contacts and for the remainder thereof to be used as signal contacts. In this case, each signal contact is positioned between two ground contacts, and the ground contacts are connected between a ground pattern formed on the circuit board CB and a ground pattern formed on the connecting object, while the signal contacts are connected between a signal pattern formed on the circuit board CB and a signal pattern formed on the connecting object.

It is possible for a circuit pattern to be formed on each of both sides of the connecting object so that the circuit patterns on both sides of the connecting object contact the contacting projections 30 and the contacting projections 32 of the contacts 25 or 25', respectively.

Additionally, a hook-shaped engaging portion (tail portion) corresponding to the hook-shaped engaging portion 29 can be formed at the front end of the fixed contact portion 26 of each contact 25 or 25'.

Additionally, each contact 25 or 25' can be substantially (lowercase) h-shaped in a side view (resembling a reversed lowercase h lying on its side) from which a rear half of the movable contact portion 27 (i.e., a portion thereof which is positioned rearward from the portion of the movable contact portion 27 which is connected to the deformable connecting portion 28) is omitted, or a substantially letter U in a side view from which both a rear half of the fixed contact portion 26 (i.e., a portion thereof which is positioned rearward from the portion of the fixed contact portion 26 which is connected to the deformable connecting portion 28) and the aforementioned rear half of the movable contact portion 27 are omitted (in this case, a hook-shaped engaging portion (tail portion) is formed at the front or rear end of the fixed contact portion 26).

Even if each contact is in the shape of a letter "H", "h" (reversed and on its side) or "U", the connector can be made as a so-called front-lock type by making the rotational actuator supported by a front half of the insulator to be rotatable between an unlocked position in which the rotational actuator oriented substantially orthogonal to the insulator 15 and a locked position in which the rotational actuator lies substantially horizontal. In this case, a cam portion (pressing portion) formed on a part of the rotational actuator is positioned between the fixed contact portions 26 and the movable contact portions 27 of the contacts while the connecting object that is inserted into the insulator is positioned immediately below the cam portion. When this rotational actuator is in the unlocked position, the pressing portion that is positioned immediately above the connecting object does not press the connecting object downward. On the other hand, when this rotational actuator is in the locked position, the pressing portion presses the connecting object downward to make a circuit pattern (not shown) that is formed on the lower surface of the connecting object come in contact with the contacting projections 30 of the contacts 25 or 25'.

Additionally, in the case where each contact is shaped into a substantially letter "h" (reversed and on its side) or "U", a recess corresponding to the recess 25*a* can be formed in a lower surface (which faces the bottom wall 20*a*) of the fixed contact portion of each contact. In this case also, it is desirable that both the front and rear lower surfaces of the fixed contact portion of each contact 25 that are positioned on the opposite sides of the recess in the forward/rearward direction be in contact with the bottom of the associated contact insertion groove 20.

Obvious changes may be made in the specific embodiments of the present invention described herein, such modifications being within the spirit and scope of the invention claimed. It is indicated that all matter contained herein is illustrative and does not limit the scope of the present invention.

What is claimed is:

1. An electrical connector comprising:

an insulator housing, into which a thin plate-shaped conductive object to be connected to said connector is removably insertable, including a plurality of contact insertion grooves and a plurality of partition walls that are positioned between said contact insertion grooves to separate said contact insertion grooves from one another, said contact insertion grooves being elongated in an insertion/removal direction of said thin plate-shaped conductive object and arranged in a direction orthogonal to said insertion/removal direction; and a plurality of contacts which are inserted into said contact insertion grooves, respectively, each of said contacts including a first contact portion and a second contact portion that are spaced from each other in a direction of thickness of said thin plate-shaped conductive object, and a connecting portion which connects said first contact portion and said second contact portion to each other, wherein at least one of said first contact portion and said second contact portion comes in contact with said thin plate-shaped conductive object when said thin plate-shaped conductive object is inserted into said insulator, wherein a hollow portion is formed in each of said plurality of partition walls of said insulator housing in such a manner as to overlap each contact of said plurality of contacts as viewed from a lateral side of said insulator in said direction orthogonal to said insertion/removal direction, and in such a manner that each partition wall of said plurality of partition walls separates each of said hollow portions from said contact insertion grooves in said direction orthogonal to said insertion/removal direction, each of said hollow portions being configured to remain open along the entire length thereof during operation of said connector.

2. The electrical connector according to claim 1, wherein said hollow portion is formed in said insulator housing so as to overlap said connecting portions of said plurality of contacts as viewed from a lateral side of said insulator in said direction orthogonal to said insertion/removal direction.

3. The electrical connector according to claim 2, wherein said hollow portion is formed in said insulator housing so as to overlap at least one of said first contact portion and said second contact portion as viewed from a lateral side of said insulator in said direction orthogonal to said insertion/removal direction.

4. The electrical connector according to claim 1, wherein said connecting portion connects a middle portion of said first contact portion in a lengthwise direction thereof and a middle portion of said second contact portion in a lengthwise direction thereof to each other, wherein said first contact portion comprises a tail portion which is formed at one end thereof in said lengthwise direction of said first contact portion and electrically connected to a circuit board, and wherein said second contact portion comprises a contacting portion which is formed at one end thereof in said lengthwise direction of said second contact portion and which comes in contact with said thin plate-shaped conductive object when said thin plate-shaped conductive object is inserted in between said first contact portion and said second contact portion.

5. The electrical connector according to claim 4, wherein said second contact portion comprises a pressure-receiving portion which is formed on an opposite side of said connecting portion from said contacting portion in said elongated direction of said second contact portion, wherein said connector further comprises an actuator which is rotatably mounted to said insulator housing and which includes a pressing portion positioned between said pressure-receiving portion and a portion of said first contact portion which faces said pressure-receiving portion, wherein said pressing portion does not press said pressure-receiving portion of said second contact portion when said actuator is positioned substantially orthogonal to said insertion/removal direction, and wherein said pressing portion presses said pressure-receiving portion to bias said contacting portion of said second contact portion toward said first contact portion when said actuator is tilted in a direction away from said contacting portion until said actuator becomes substantially parallel to said insertion/removal direction.

6. The electrical connector according to claim 1, wherein said first contact portion comprises a tail portion which is formed at one end thereof in said lengthwise direction of said first contact portion and electrically connected to a circuit board, wherein said second contact portion comprises a contacting portion formed at one end thereof which is farther from said tail portion of said first contact portion than the other end of said second contact portion in said lengthwise direction of said second contact portion, said contacting portion coming in contact with said thin plate-shaped conductive object when said thin plate-shaped conductive object is inserted in between said first contact portion and said second contact portion, and wherein said connecting portion connects said other end of said second contact portion and said first contact portion to each other.

7. The electrical connector according to claim 6, wherein said connector further comprises an actuator which is rotatably mounted to said insulator housing and which includes a pressing portion positioned between said second contact portion and a portion of said first contact portion which faces said second contact portion, wherein said pressing portion does not press said thin plate-shaped conductive object which is inserted into said insulator housing when said actuator is positioned substantially orthogonal to said insertion/removal direction, and wherein said pressing portion presses said thin plate-shaped conductive object toward said first contact portion when said actuator is tilted until becoming substantially parallel to said insertion/removal direction.

* * * * *